US010308481B2

(12) United States Patent
Giorgioni

(10) Patent No.: US 10,308,481 B2
(45) Date of Patent: Jun. 4, 2019

(54) ELEVATOR DOOR AND METHOD FOR OPENING AN ELEVATOR DOOR HAVING TWO SLIDING DOOR PANELS

(71) Applicant: WITTUR Holding GmbH, Wiedenzhausen (DE)

(72) Inventor: Paolo Giorgioni, Montecagno (IT)

(73) Assignee: WITTUR HOLDING GMBH, Wiedenzhausen (DE)

( * ) Notice: Subject to any disclaimer, the term of this patent is extended or adjusted under 35 U.S.C. 154(b) by 0 days.

(21) Appl. No.: 15/554,997

(22) PCT Filed: Sep. 25, 2015

(86) PCT No.: PCT/IB2015/057391
§ 371 (c)(1),
(2) Date: Aug. 31, 2017

(87) PCT Pub. No.: WO2016/147035
PCT Pub. Date: Sep. 22, 2016

(65) Prior Publication Data

US 2018/0105398 A1 Apr. 19, 2018

(30) Foreign Application Priority Data

Mar. 19, 2015 (IT) ..... 102015000009110

(51) Int. Cl.
*B66B 13/26* (2006.01)
*B66B 13/30* (2006.01)

(52) U.S. Cl.
CPC ..... *B66B 13/301* (2013.01); *B66B 13/26* (2013.01)

(58) Field of Classification Search
CPC ..... B66B 13/26; B66B 13/28; B66B 13/301
See application file for complete search history.

(56) References Cited

U.S. PATENT DOCUMENTS

2002/0125077 A1* 9/2002 Shikai ..... B66B 13/26 187/317
2006/0243534 A1* 11/2006 Miller ..... B66B 13/24 187/313
2007/0221456 A1* 9/2007 Ducas ..... B66B 13/301 187/400
2010/0031579 A1* 2/2010 Choi ..... B66B 13/30 49/503

FOREIGN PATENT DOCUMENTS

JP 10059665 A * 3/1998 ..... B66B 13/301
JP 2000118931 A 4/2000
(Continued)

OTHER PUBLICATIONS

English Machine Translation of JP2009249116.*
(Continued)

*Primary Examiner* — Diem M Tran
(74) *Attorney, Agent, or Firm* — Ference & Associates LLC

(57) ABSTRACT

Car door (1) comprising: two sliding door panels (2, 3); two profiles (6, 7), each of which is arranged below one of the two door panels (2, 3), the profiles (6, 7) being partially counter-shaped so as to slide with respect to one another therefore while the door (1) is opening they move towards one another to compose a sill (5).

5 Claims, 5 Drawing Sheets

(56) References Cited

FOREIGN PATENT DOCUMENTS

| | | | | |
|---|---|---|---|---|
| JP | 2008024402 | A | * | 2/2008 |
| JP | 2009249116 | A | | 10/2009 |
| JP | 2010143730 | A | | 1/2010 |
| JP | 2013180861 | A | | 12/2013 |

OTHER PUBLICATIONS

International Search Report for PCT/IB2015/057391, 2 pages.
International Preliminary Report on Patentability for PCT/IB2015/057391, 5 pages.

* cited by examiner

ELEVATOR DOOR AND METHOD FOR OPENING AN ELEVATOR DOOR HAVING TWO SLIDING DOOR PANELS

TECHNICAL FIELD

The present invention relates to an elevator door and a method for opening an elevator door having two sliding door panels.

BACKGROUND ART

As is known, within an elevator compartment a car is arranged that is vertically slidable. Such a car has one or more passages or openings with which a door is associated.

In this context, reference is made to sliding car doors, in particular equipped with lower sliding blocks that slide within a groove or hollow afforded in the door sill. The guide for the car door panels through a grooved sill is known for car doors with one or more centrally or telescopically opening door panels, with linear or circular sills.

The presence of the sliding block in the door panels guarantees precise opening and closing, preventing the door panels themselves getting warped or broken.

One of the drawbacks of this solution is represented by the fact that the grooved sill gets filled with dirt and waste which, often being difficult to remove, may even hinder the sliding of the door panels.

When the car stops at a floor of the building, its sill is aligned with the sill of the relative floor door, arranging itself substantially at the same horizontal level as the latter.

As is known, between the outside of the car and the wall with which the floor doors are associated, there is an opening, i.e. an empty tolerance space in order to prevent the car interfering with the wall during its vertical motion, which would cause interference or collisions as well as noise in the system.

The presence of the opening between the car and the wall translates into a distance, for example 25-30 mm between the car sill and the floor sill. Therefore, there is a gap of a substantial size between the two sills, responsible for tripping, problems entering with prams or walking frames that have wheels, undesired falling of small items (e.g. keys), etc.

Since the opening between the car and the wall cannot be reduced below a minimum value—without compromising the quality of the car's travel and the wear on it—various manufacturers have tried to limit the size of the gap between the sills only during the car opening phase.

Document CN101948070 illustrates a centrally opening car door wherein an additional metal profile, equipped with an arched groove, is installed directly on the sill. Each door panel is provided at the bottom with a pin sliding in the arched groove so that, during the opening of the door, the sliding of such pin makes the additional profile advance until the gap is covered. Vice versa, when the door is closed the additional profile returns into the sill so as not to compromise the vertical motion of the car.

The concept of an "auxiliary sill" that is extractable/retractable with respect to the main sill of the car door is also proposed in documents CN102992151, JP2007320735 and WO2005/035421. Such documents show various auxiliary sill movement mechanisms, such as rollers, helical wheels, cams, etc. in some cases even very complex.

Furthermore, the extracted auxiliary sill is temporarily anchored to the floor sill to guarantee its stability.

Finally, the auxiliary sill is associated with a grooved sill for the sliding of the door, therefore the problem of dirt accumulating remains. Furthermore, these solutions are also affected by noise and vibrations.

A commercial solution proposed by the Applicant envisages during the opening of the car door the auxiliary sill being located in the centre of the gap so as to substantially split it into two smaller gaps.

In this context, the technical task at the basis of the present invention is proposing an elevator door and a method for opening an elevator door having two sliding door panels which overcome the problems of the prior art cited above.

DISCLOSURE OF THE INVENTION

In particular, it is an object of the present invention to provide an elevator door and a method for opening an elevator door having two sliding door panels, which reduce the gap between the car sill and the floor sill simply and compactly with respect to the prior art, at the same time solving the problem of interference (and noise).

A further object of the present invention is to propose an elevator door that does not require frequent and difficult sill cleaning.

Another object of the present invention is to provide a less bulky and complex elevator door than the known solutions.

The stated technical task and specified objects are substantially achieved by an elevator door comprising:

at least two sliding door panels;

means for moving said door panels between a first configuration wherein the door is closed and a second configuration wherein the door is open and vice versa;

a sill that can be horizontally aligned with another sill, characterised in that it comprises a profile for each door panel, such profile being arranged below the corresponding door panel and having a first portion integrally constrained to the door panel and a second portion projecting towards said further sill, the profiles being conformed so as to be mutually slidable therefore when passing from the first to the second configuration the second projecting portions move towards one another in order to compose the sill which projects towards the further sill, and when passing from the second to the first configuration the second projecting portions move away from one another in order to disassemble the sill.

Preferably, the elevator door is a car door, therefore the sill that is composed is the car sill.

Preferably, the profiles are partially counter-shaped so as to slide with respect to one another.

Preferably, the second projecting portion of one of the profiles has a groove in which the first portion of the other profile is slidably inserted.

In the preferred embodiment, there are two door panels and the opening is central.

Preferably, there are no hollow guides for the sliding of the door panels.

Preferably, the door panels are constrained to the first portions of the corresponding profiles through screws or rivets.

Alternatively, the door panels are welded to the first portions of the corresponding profiles.

Preferably, means are provided for detecting the load which are operatively active on the profiles for detecting the presence of a load. Furthermore, a safety device is provided which, in response to the detection of a load weighing over a pre-established value during the passage of the door panels from the second to the first configuration, controls the return to the second configuration or the stopping of the movement of the door panels until said load is removed.

The stated technical task and specified objects are substantially reached by a method for opening an elevator door having two sliding door panels, comprising a step of making the door panels slide open, characterised in that during the sliding of the door panels, each door panel drags a corresponding profile integral with it and arranged below it, said profiles having projecting portions that during the sliding of the door panels move towards one another to compose a sill projecting towards another door.

BRIEF DESCRIPTION OF DRAWINGS

Additional features and advantages of the present invention will become more apparent from the approximate and thus non-limiting description of a preferred but not exclusive embodiment of a car door and a method for opening a car door having two sliding door panels, as illustrated in the appended drawings, in which.

DETAILED DESCRIPTION OF PREFERRED EMBODIMENTS OF THE INVENTION

Figure 1:
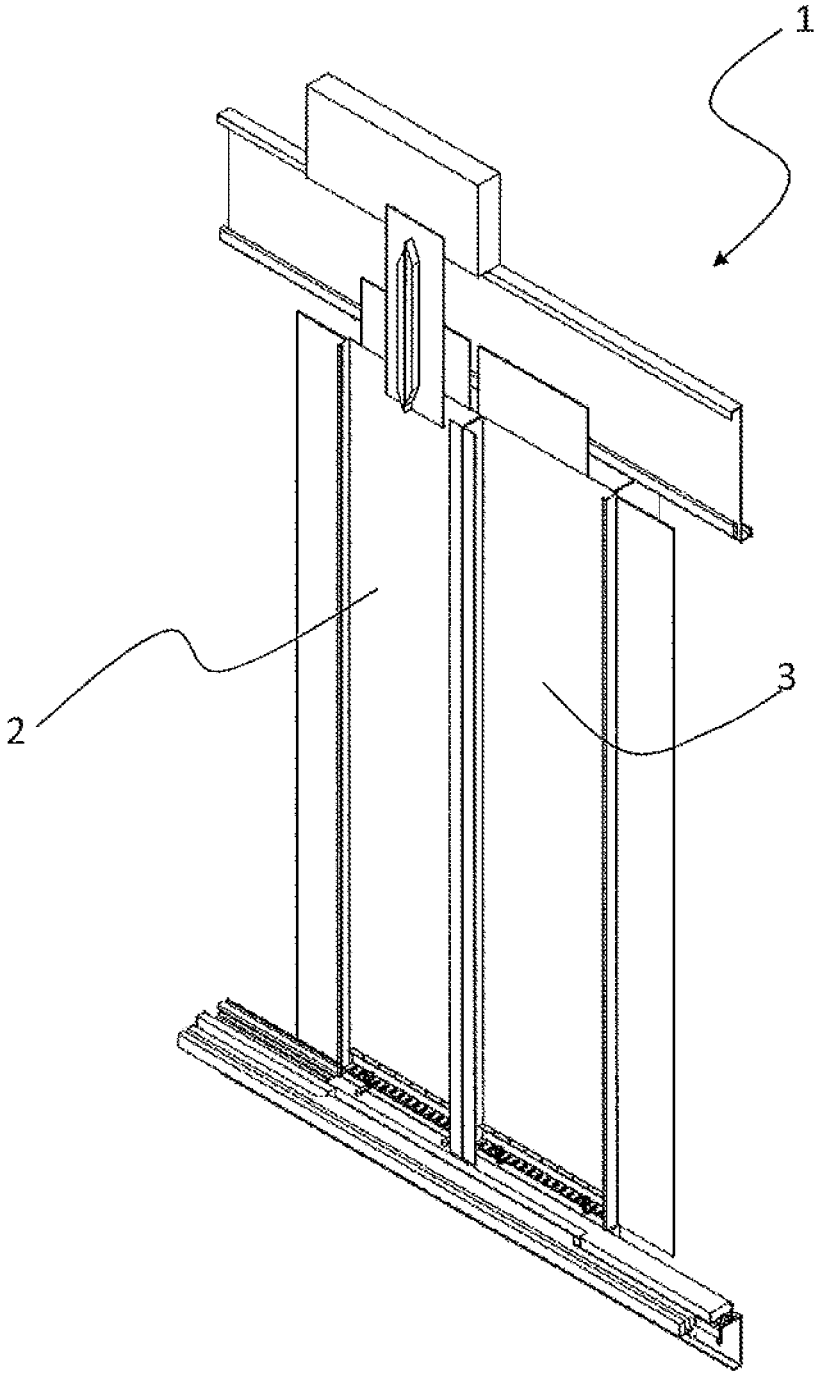
FIG. 1 illustrates a perspective view of an elevator door (car door), according to the present invention, in closed conditions.
Figure 2:
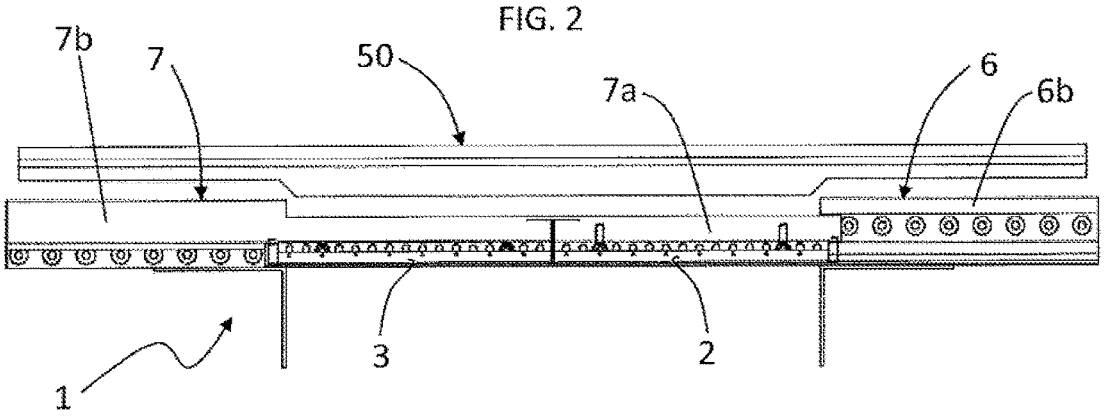
FIG. 2 illustrates a plan view of the car door of FIG. 1.
Figure 3:
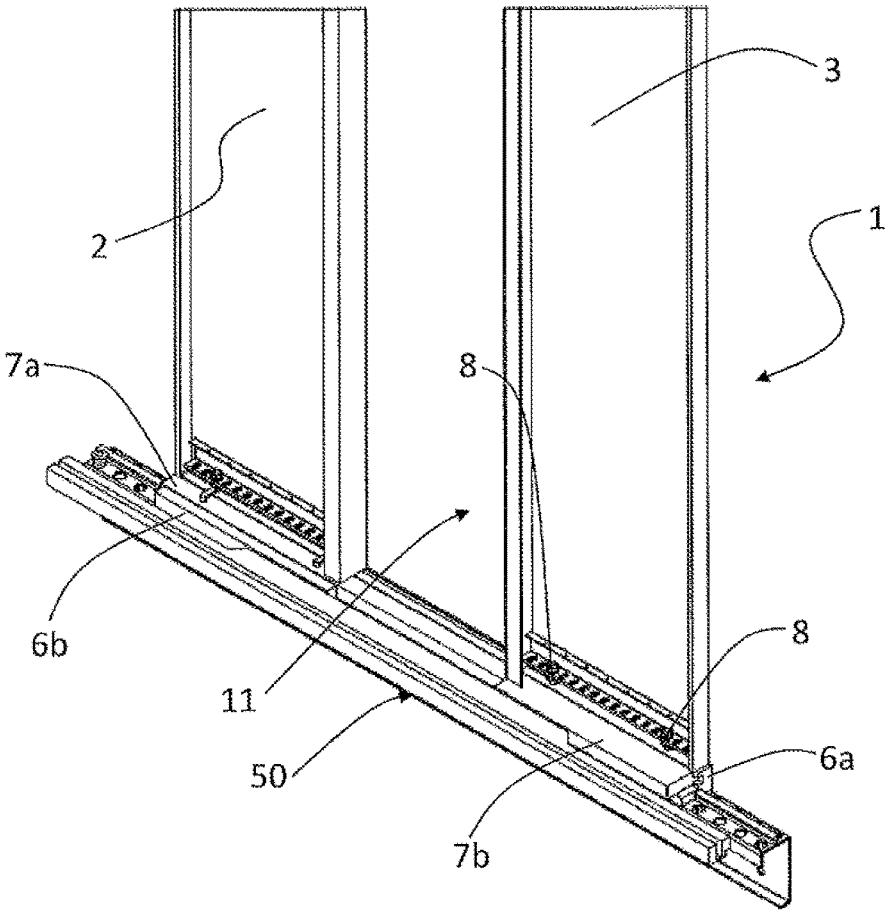
FIG. 3 illustrates a perspective view of the car door of FIG. 1, in partially open conditions.
Figure 4:
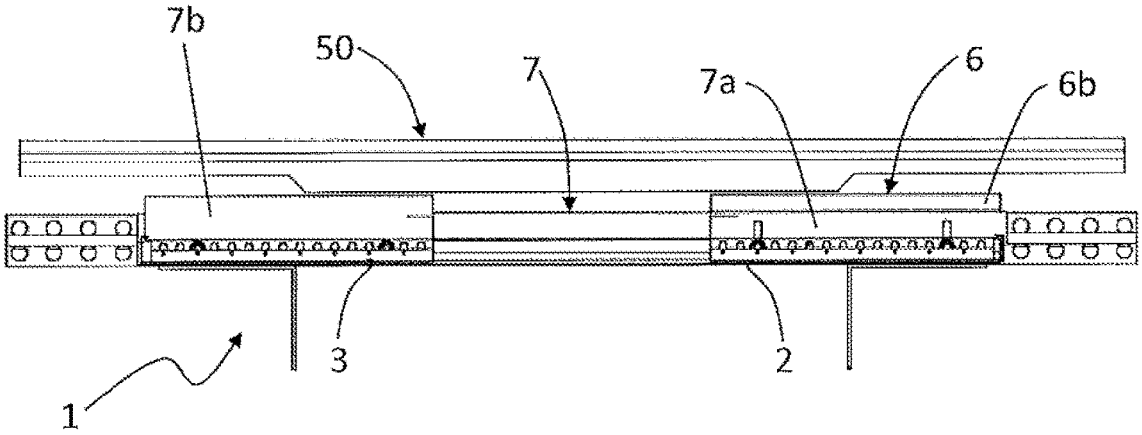
FIG. 4 illustrates a plan view of the car door of FIG. 3.

With reference to the figures, number 1 indicates an elevator door, for example a car door to be used in the car of an elevator. In particular, the car door 1 comprises at least two sliding door panels 2, 3.

In the embodiment described and illustrated herein, there are two door panels 2, 3 and the opening is central. In another embodiment (not illustrated), the opening of the door panels 2, 3 is lateral, i.e. telescopic.

The car door 1 comprises means for moving the door panels 2, 3 to bring them from a first configuration wherein the car door 1 is closed to a second configuration wherein the car door 1 is open, and vice versa.

In the embodiment described and illustrated herein, the door panels 2, 3 are moved away from one another to pass from the first to the second configuration and are moved towards one another to pass from the second to the first configuration.

The movement means are of the known type and will not be described further.

The car door 1 comprises a car sill 5 that can be horizontally aligned with a floor sill 50.

As will be explained below, the car sill 5 is not always present but is constituted in the opening step of the car door 1 and remains assembled while the car door 1 remains open.

Originally, the car door 1 comprises a profile 6, 7 for each door panel 2, 3. In other words, the same number of profiles 6, 7 as the number of door panels 2, 3 are provided.

Each profile 6, 7 is arranged below the corresponding door panel 2, 3. This means that, with respect to the ground, each profile 6, 7 is at a lower horizontal level than the corresponding door panel 2, 3.

For example, the profiles 6, 7 are made of metal or plastic or marble or glass or wood.

Each profile 6, 7 has a first portion 6*a*, 7*a* which is integrally constrained to the corresponding door panel 2, 3.

In the embodiment described and illustrated herein, the first portions 6*a*, 7*a* of the profiles 6, 7 are constrained to the corresponding door panels 2, 3 through fixing elements 8 such as screws or rivets.

In an alternative embodiment (not illustrated), the door panels 2, 3 are welded to the first portions 6*a*, 7*a* of the corresponding profiles 6, 7.

Each profile 6, 7 has a second projecting portion 6*b*, 7*b*, i.e. protruding, in the direction of the floor sill 50.

Advantageously, the profiles 6, 7 are conformed so as to be mutually slidable therefore when the door panels 2, 3 pass from the first to the second configuration the second projecting portions 6*b*, 7*b* move towards each other to compose, i.e. assemble, the car sill 5.

Figure 5:
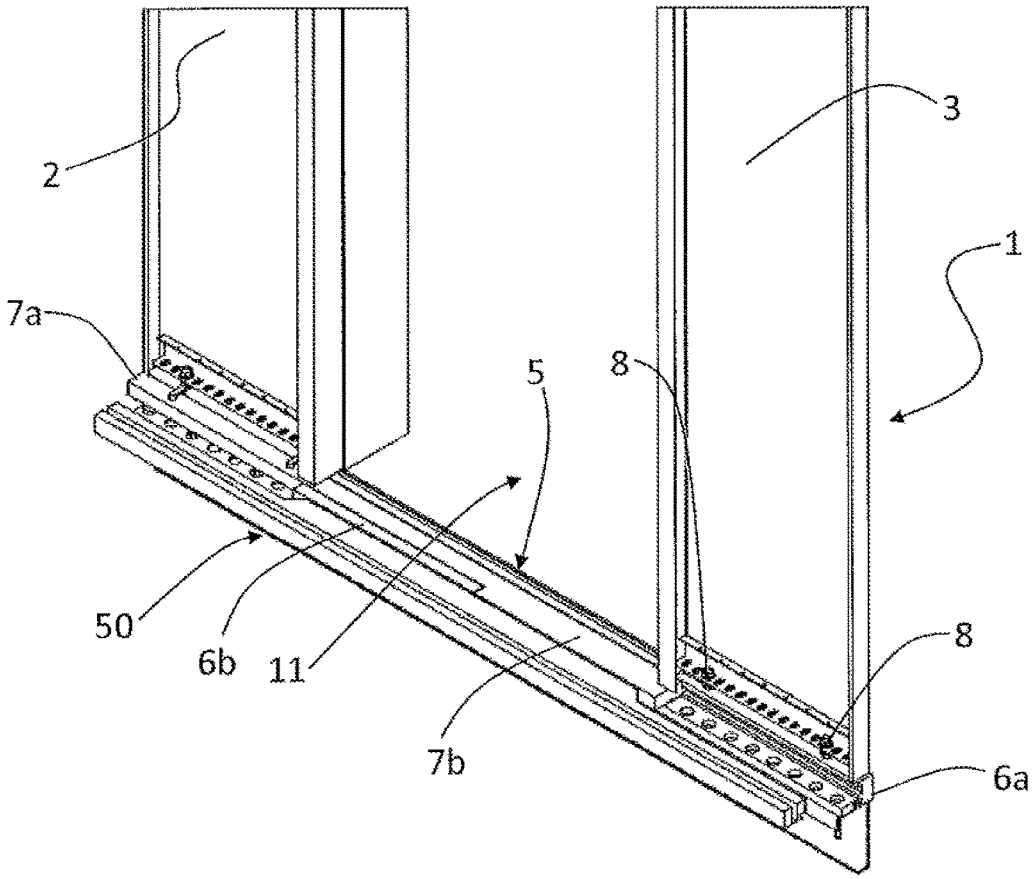
FIG. 5 illustrates a perspective view of the car door of FIG. 1, in totally open conditions.
Figure 6:
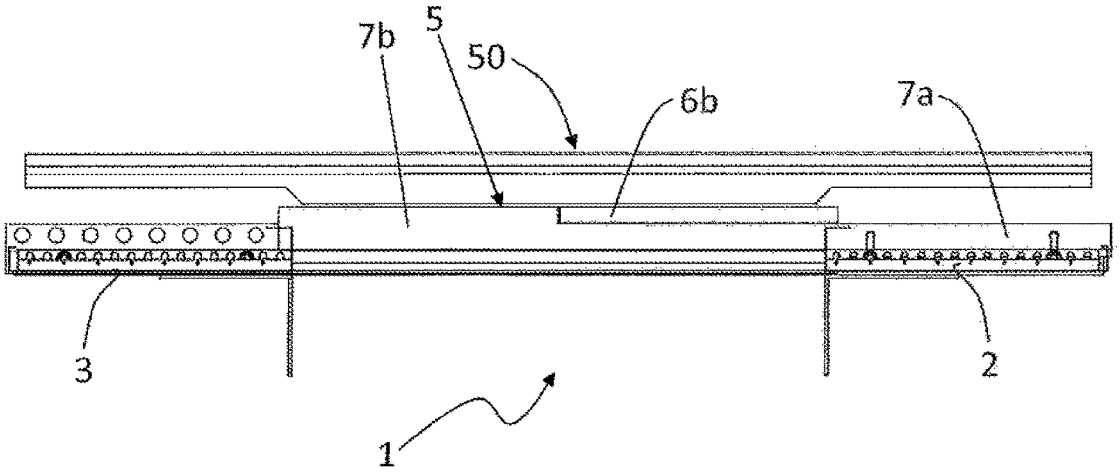
FIG. 6 illustrates a plan view of the car door of FIG. 5.

The car sill 5 thus obtained projects towards the floor sill 50 (see FIGS. 5-6).

When the door panels 2, 3 pass from the second to the first configuration, the second projecting portions 6*b*, 7*b* move away from one another to decompose, i.e. disassemble, the car sill 5 (see figures from 1 to 4).

Preferably, the profiles 6, 7 are partially counter-shaped so as to slide with respect to one another.

In particular, the profiles 6, 7 slide parallel to the door panels 2, 3.

In the embodiment described and illustrated herein, there are two profiles 6, 7 and two door panels 2, 3.

Figure 7:
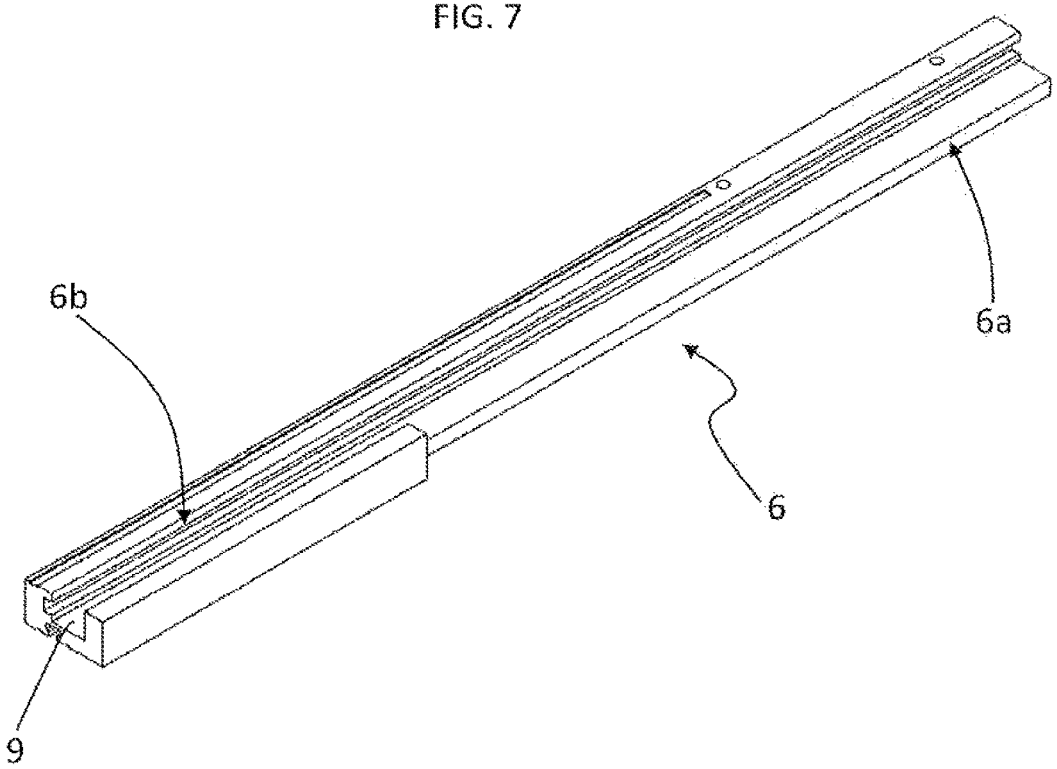
FIG. 7 illustrates a perspective view of the first profile of the car door of FIG. 1.

In this case, one of the profiles (indicated for convenience purposes as "first profile" 6) has a groove 9 afforded in its second projecting portion 6*b*, as shown in FIG. 7.

Figure 8:
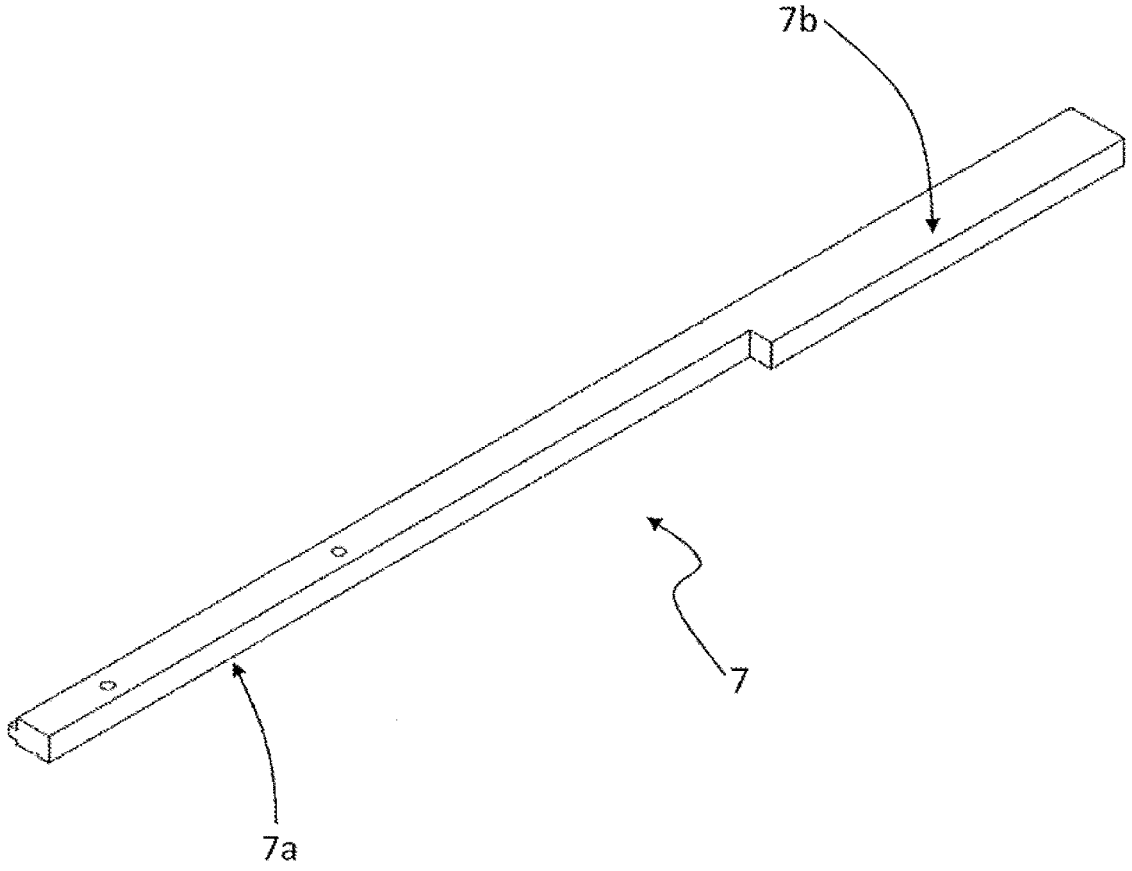
FIG. 8 illustrates a perspective view of the second profile of the car door of FIG. 1.

In such a groove 9 the first portion 7*a* of the other profile (indicated for convenience purposes as "second profile" 7 and illustrated in FIG. 8) is slidably inserted.

Advantageously, the door panels 2, 3 slide dragging the corresponding profiles 6, 7 integral with them, which create the car sill 5 when required, without needing lower hollows for guiding the door panels 2, 3.

Preferably, the car door 1 comprises means for detecting the load (not illustrated) operatively active on the profiles 6, 7 to detect the presence of a weight and a safety device (not illustrated) associated with the load detection means.

In particular, in response to the detection of a weight over a pre-established value during the passage of the door panels 2, 3 from the second to the first configuration (i.e. when the car door 1 is closing), the safety device controls the return to the second configuration (i.e. it makes the car door 1 open again) or the stopping of the movement of the door panels 2, 3 until said weight is removed.

In the embodiment described and illustrated herein, the car door 1 has a linear opening therefore the profiles 6, 7 extend along a prevalent direction that is longitudinal and parallel to the door panels 2, 3.

In an alternative embodiment, the car door 1 has a circular opening therefore the profiles 6, 7 extend along a prevalent direction which is arched.

Up to now a car door has been described, however the profiles 6, 7 thus conformed could be used to compose the sill of a floor door.

The method for opening an elevator door having two sliding door panels is described below, with particular reference to the car door.

The car, initially with a closed door (door panels 2, 3 in the first configuration), is moved vertically within an elevator compartment.

When the car reaches the desired floor, the car door 1 faces the corresponding floor door.

At this point, the door panels 2, 3 slide from the first to the second configuration.

In the embodiment described and illustrated herein, the door panels 2, 3 are reciprocally moved away from one another so as to create a passage 11.

When passing from the first to the second configuration, each door panel 2, 3 drags through its motion the corresponding profile 6, 7 integral to it.

In particular, the first portion 7*a* of the second profile 7 slides with respect to the groove 9 present in the second projecting portion 6*b* of the first profile 6. Such mutual sliding causes the second projecting portions 6*b*, 7*b* of the profiles 6, 7 to move towards one another, thus defining the car sill 5 (see FIGS. 5-6).

Preferably, the second projecting portions 6*b*, 7*b* move towards one another until they are adjacent to one another defining a car sill 5 in which no discontinuities are perceived by those walking over it.

The car sill 5 thus formed projects towards the floor sill 50 and is 1 mm to 5 mm away from it.

During the opening of the car door 1, the load detection means detect the passing of people, animals or objects (e.g. prams) through the passage 11. When their weight is over a pre-established value, the safety device intervenes which controls the reopening of the car door 1 or the stopping of the door panels 2, 3 until the object or person or animal is removed. In that way, there is no interference with the second projecting portions 6*b*, 7*b* which are moving towards one another.

The characteristics of the elevator door and method for opening an elevator door having two sliding door panels appear clear from the description provided.

In particular, the presence of the lower profiles integral with the door panels and conformed so as to slide mutually allows:

- the 25-30 mm opening to be maintained between the car and the floor door during the vertical movement of the car in the elevator compartment;
- a car sill to be created while the door is opening and for the whole time it remains open, hence reducing the 25-30 mm opening to 1-5 mm, corresponding to the distance between the car sill thus obtained and the floor sill.

With respect to solutions that envisage the auxiliary sill (extractable/retractable), the invention described herein provides a further advantage, i.e. that of assembling and disassembling the car sill as required. In practice, when the car door is closed, the sill is not required therefore it does not exist (it is disassembled). Such car sill is composed, i.e. assembled, when the door opens.

In fact, the projecting portions of the two profiles are arranged within the passage area only during the door opening step.

Furthermore, the door panels no longer require a guide since it is the mutual sliding of the counter-shaped profiles that acts indirectly as a guide for the sliding of the door panels. Therefore, hollows for the sliding of the door panels are no longer required. Therefore, the proposed solution is not affected by problems of dirt accumulating in the hollows (as there are no hollows).

Finally, the presence of load detection means and the safety device prevent tripping during the opening of the car door, i.e. when the car sill is being composed. In this way, not only are obstacles detected during the door closing step (as already happens in known solutions), but information can be generated for the system diagnostics thanks to the detection of obstacles during parking with the door open.

The invention claimed is:

1. Car door for an elevator comprising:

at least two sliding door panels;

means for moving said door panels between a first configuration wherein the door is closed and a second configuration wherein the door is open and vice versa;

a car sill that can be horizontally aligned with a floor sill, characterised in that it comprises:

a profile for each door panel, said profile being arranged below the corresponding door panel and having an elongated extension with a first portion integrally constrained to said door panel and a second portion projecting towards said floor sill, the second portion of one of the profiles having a groove in which the first portion of the other profile is slidably inserted, so that when passing from the first to the second configuration said second projecting portions move towards one another in order to compose said car sill which projects towards the floor sill, and when passing from the second to the first configuration said second projecting portions move away from one another in order to disassemble said car sill, each door panel dragging through its motion the corresponding profile integral to it.

2. Elevator door according to claim 1, wherein there are two door panels and the opening is central.

3. Elevator door according to claim 1, wherein the second projecting portion of one of the profiles has a groove in which the first portion of the other profile is slidably inserted.

4. Elevator door according to claim 1, wherein said door panels are constrained to the first portions of the corresponding profiles through screws or rivets.

5. Elevator door according to claim 1, wherein said door panel are welded to the first portions of the corresponding profiles.

* * * * *